US006969166B2

(12) United States Patent
Clark et al.

(10) Patent No.: US 6,969,166 B2
(45) Date of Patent: Nov. 29, 2005

(54) METHOD FOR MODIFYING THE SURFACE OF A SUBSTRATE

(75) Inventors: John C. Clark, White Bear Lake, MN (US); Peter T. Elliott, Woodbury, MN (US); Caroline M. Ylitalo, Stillwater, MN (US); Naiyong Jing, Woodbury, MN (US); Gary A. Korba, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 141 days.

(21) Appl. No.: 10/447,774

(22) Filed: May 29, 2003

(65) Prior Publication Data

US 2004/0241451 A1 Dec. 2, 2004

(51) Int. Cl.[7] ..... B41J 2/01

(52) U.S. Cl. ..... 347/101; 347/105; 429/32.1

(58) Field of Search ..... 347/101, 105, 347/96, 100; 428/195, 32.1; 156/235; 400/1; 101/1; 283/1; 422/1

(56) References Cited

U.S. PATENT DOCUMENTS

| | | | |
|---|---|---|---|
| 2,803,615 | A | 8/1957 | Albrecht et al. |
| 3,503,915 | A | 3/1970 | Peterson |
| 4,132,681 | A | 1/1979 | Field et al. |
| 4,141,873 | A | 2/1979 | Dohany |
| 4,446,269 | A | 5/1984 | Silva et al. |

(Continued)

FOREIGN PATENT DOCUMENTS

| | | | |
|---|---|---|---|
| EP | 0 679 702 | A1 | 11/1995 |
| EP | 1 011 298 | A1 | 6/2000 |
| EP | 1 138 729 | A1 | 10/2001 |
| EP | 0 919 370 | A1 | 3/2002 |
| GB | 2 379 083 | A | 2/2003 |

(Continued)

OTHER PUBLICATIONS

Martin et al., "Self–Alignment of Patterned Wafers Using Capillary Forces at a Water–Air Interface", Advanced Functional Materials, 11, No. 5, pp. 381–386 (2001).

Pardo et al., "Characterization of Patterned Self–Assembled Monolayers and Protein Arrays Generated by the Ink–Jet Method", Langmuir, vol. 19, No. 5, 2003, pp. 1462–1466 (2002).

Tiensuu et al., "Hydrophobic Valves by Ink–Jet Printing on Plastic CDs with Integrated Microfluidics", Micro Total Analysis Systems, pp. 575–578 (2000).

Zhao et al., "Surface–Directed Liquid Flow Inside Microchannels", Science, vol. 291 (9), pp. 1023–1026 (2001).

S. Wu, "Polymer Interface and Adhesion", Marcel Dekker, Inc, pp. 406–434 (1982).

U.S. Appl. No. 10/161,258, filed May 31, 2002, Fluorinated Phosphonic Acids.

U.S. Appl. No. 10/335,494, filed Dec. 31, 2002, Method for Modifying the Surface of a Polymeric Substrate.

U.S. Appl. No. 10/447,772, filed May 29, 2003, Method of Modifying a Surface of a Substrate and Articles Therefrom.

U.S. Appl. No. 10/447,803, filed May 29, 2003, Method for Applying an Adhesive to a Substrate.

U.S. Appl. No. 10/448,229, filed May 29, 2003, Methods of Modifying a Surface of a Substrate and Articles Therefrom.

*Primary Examiner*—Manish S. Shah

(57) ABSTRACT

At least two fixable fluid materials are digitally applied adjacent to each other on a surface of a substrate and fixed to provide fixed coatings having different surface energies The first fixed coating has a first average receding contact angle with water, and the second fixed coating has a second average receding contact angle with water, wherein the magnitude of the difference between the first and second average receding contact angle is at least 30 degree. The coated substrates are useful for controlling the flow of fluid.

41 Claims, 4 Drawing Sheets

U.S. PATENT DOCUMENTS 5,061,535 A 10/1991 Kreckel et al.
5,121,134 A 6/1992 Albinson et al.
5,216,097 A 6/1993 Allewaert et al.
5,217,805 A 6/1993 Kessel et al.
5,286,815 A 2/1994 Leir et al.
5,340,898 A 8/1994 Cavezzan et al.
5,459,191 A 10/1995 Tuminello et al.
5,514,728 A 5/1996 Lamanna et al.
5,554,664 A 9/1996 Lamanna et al.
5,674,592 A 10/1997 Clark et al.
5,772,743 A 6/1998 Gundlach et al.
5,863,320 A 1/1999 Breton et al.
5,912,280 A 6/1999 Anton et al.
5,919,293 A 7/1999 Moffatt et al.
5,919,878 A 7/1999 Brothers et al.
5,928,726 A 7/1999 Butler et al.
6,127,452 A 10/2000 Kato
6,156,389 A 12/2000 Brown et al.
6,156,824 A 12/2000 Yamada et al.
6,200,369 B1 3/2001 Schwarz
6,306,204 B1 10/2001 Lin
6,312,759 B1 11/2001 Yamada et al.
6,344,309 B2 2/2002 Fukushima et al.
6,350,306 B1 2/2002 Tonelli et al.
6,352,758 B1 3/2002 Huang et al.
6,365,276 B1 4/2002 Rudisi et al.
6,376,065 B1 4/2002 Korba et al.
6,383,274 B1 5/2002 Lin
6,433,359 B1 8/2002 Kelley et al.
6,451,717 B1 9/2002 Fitzgerald et al.
6,461,419 B1 10/2002 Wu et al.
6,471,761 B2 10/2002 Fan et al.
6,485,138 B1 11/2002 Kubota et al.
6,503,831 B2 1/2003 Speakman
6,513,897 B2 2/2003 Tokie
6,518,352 B1 2/2003 Visca et al.
6,592,659 B1 7/2003 Terrazas et al.
2001/0020964 A1 * 9/2001 Irihara et al. ..... 347/43
2001/0036510 A1 11/2001 Engle et al.
2002/0045270 A1 4/2002 Schurenberg et al.
2002/0057051 A1 5/2002 Kobayashi
2002/0086914 A1 7/2002 Lee et al.
2002/0105080 A1 8/2002 Speakman
2002/0121705 A1 9/2002 Pu et al.
2002/0128340 A1 9/2002 Young et al.
2002/0150734 A1 10/2002 Snow et al.
2002/0158951 A1 10/2002 Tyvoll
2002/0160139 A1 10/2002 Huang et al.
2002/0197481 A1 12/2002 Jing et al.
2003/0026995 A1 2/2003 Duchesne et al.
2003/0059987 A1 3/2003 Sirringhaus et al.
2003/0064005 A1 * 4/2003 Sasaki et al. ..... 422/82.05
2003/0083396 A1 5/2003 Ylitalo et al.
2003/0085974 A1 * 5/2003 Shimomura et al. ..... 347/101
2003/0113555 A1 6/2003 Pellerite et al.

FOREIGN PATENT DOCUMENTS

JP 59-176329 10/1984
JP 07035917 A 2/1995
JP 10115703 A 5/1998
JP 2001272528 A 3/2000
JP 2002-040637 6/2002
WO WO 98/45052 10/1998
WO WO 99/58245 11/1999
WO WO 01/11426 A1 2/2001
WO WO 01/46987 A2 6/2001
WO WO 01/58697 A2 8/2001
WO WO 02/20676 A1 3/2002
WO WO 02/24792 A2 3/2002

* cited by examiner

METHOD FOR MODIFYING THE SURFACE OF A SUBSTRATE

FIELD

The present invention relates to methods for modifying the surface of a substrate.

BACKGROUND

Wetting behavior of a liquid on a substrate surface is typically a function of the surface energy of the substrate surface and the surface tension of the liquid. At the liquid-substrate surface interface, if the molecules of the liquid have a stronger attraction to the molecules of the substrate surface than to each other (the adhesive forces are stronger than the cohesive forces), then wetting of the substrate surface generally occurs. Alternatively, if the molecules of the liquid are more strongly attracted to each other than to the molecules of the substrate surface (the cohesive forces are stronger than the adhesive forces), then the liquid generally beads-up and does not wet the surface of the substrate.

One way to quantify surface wetting characteristics of a liquid on a surface of a substrate is to measure the contact angle of a drop of liquid placed on that surface. The contact angle is the angle formed by the solid/liquid interface and the liquid/vapor interface measured from the side of the liquid. Liquids typically wet surfaces when their contact angle is less than 90 degrees. Typically, a decrease in the contact angle between the liquid and the surface correlates with an increase in wetting. A zero contact angle generally corresponds to spontaneous spreading of the liquid on the surface of the substrate.

For many applications (e.g., sensors and microfluidic devices), the ability to precisely control the wetting and/or flow of a liquid on a surface of a substrate according to a precise high-resolution pattern can be important. Thus, it would be desirable to have additional methods and materials that can provide such control.

SUMMARY

In one aspect, the present invention provides a method of modifying a surface of a substrate comprising:

providing a substrate having a surface;

digitally applying a first fixable fluid material to at least a portion of the surface of the substrate;

fixing the first fixable fluid material to provide a first fixed coating on at least a portion of the surface of the substrate, wherein the first fixed coating has a first average receding contact angle with water;

digitally applying a second fixable fluid material to at least one of a portion of the surface of the substrate and a portion of the first fixed coating; and fixing the second fluid material to provide a second fixed coating, wherein the second fixed coating is adjacent to the first fixed coating, wherein the second fixed coating has a second average receding contact angle with water, wherein the magnitude of the difference between the first and second average receding contact angles is at least 30 degrees.

In one embodiment according to the present invention, the first and second fixed coatings contact each other.

In one embodiment according to the present invention, the method further comprises applying a third fluid material to at least one of the first and second fixed coatings.

In another aspect, the present invention provides an article comprising a substrate having a surface, and first and second fixed coatings, wherein the first fixed coating has a first receding contact angle with water and contacts the substrate, wherein the second fixed coating has a second receding contact angle with water and contacts at least one of the substrate and the first fixed coating, wherein the first and second fixed coatings are adjacent, wherein the magnitude of the difference between the first and second receding contact angles is at least 30 degrees, and wherein at least one of the first and second fixed coatings comprises an array of dots having a resolution in at least one dimension of greater than or equal to 300 dots per inch.

In one embodiment according to the present invention, the second fixed coating contacts the first fixed coating.

Methods and articles according to the present invention are typically useful for controlling wetting and/or flow of a fluid on the surface of a substrate.

In this application, all contact angles with water refer to determinations using deionized water at 22° C., unless otherwise specified.

DETAILED DESCRIPTION

Figure 1A:
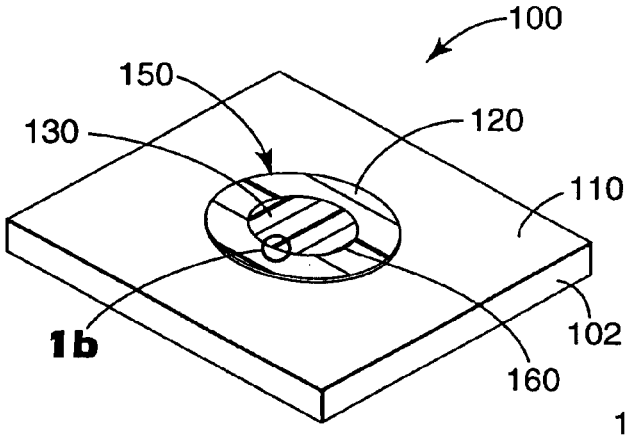
FIG. 1*a* is a perspective view of an exemplary article according to one embodiment of the present invention.

In practice of the present invention, a first fixable fluid material is digitally applied to a first region of the surface of the substrate and fixed to provide a first coating. A second fixable fluid material is digitally applied to a second region of the surface of the substrate and/or the first fixed coating, and fixed to provide a second fixed coating. The second fixed coating is adjacent to, and may contact, the first fixed coating. In one embodiment according to the present invention, the second fixed coating may be identically superimposed on the first fixed coating, however in other embodiments of the present invention it is not.

Fixing of the fixable fluid materials may be sequential or simultaneous. Fixing may be, for example, spontaneous or result from an additional step. Exemplary methods of fixing include evaporation (e.g., removal of volatile solvent), cooling (e.g., resulting in a phase change from liquid to solid, or viscosity thickening), and curing (e.g., polymerization and/or crosslinking). After fixing, each material has a characteristic average surface energy. By selecting materials that result in fixed materials with sufficiently different surface energies, fluid control elements may be generated directly using digital methods. Failure to fix the first fixable fluid material prior to printing the second fixable fluid material may, for example, result in movement of the first fixable fluid material from its original printed location on the substrate surface prior to printing the second fixable fluid material (e.g., during handling of the printed substrate), and/or mixing of the first and second fixable fluid materials. Thus, the term "fixed coating" does not include coatings that are liquids.

In order to apply materials to a substrate surface as described above, conventional methods (e.g., screen printing) typically require a changeover step and/or have problems in maintaining precise registration during the application process. This generally leads to wasted material and time delays. Further, conventional processes are generally not well suited to short run applications (i.e., those processes in which few article(s) are to be imaged before a change in the image design is necessary). In contrast, digital application methods typically overcome such problems by applying material when and where it is desired.

Further, by applying at least two suitably selected materials, it is typically possible to create fluid control elements on any substrate without relying upon the specific surface properties of the substrate. Thus, identical fluid control elements may be prepared on substrates composed of dissimilar materials (e.g., glass and polyolefin).

Useful digital application methods include, for example, spray jet, valve jet, and inkjet printing methods. Techniques and formulation guidelines are well known (see, for example, "Kirk-Othmer Encyclopedia of Chemical Technology", Fourth Edition (1996), volume 20, John Wiley and Sons, New York, pages 112–117, the disclosure of which is incorporated herein by reference) and are within the capability of one of ordinary skill in the art. Combinations of these methods may also be employed in practice of the present invention as described, for example, in U.S. Pat. No. 6,513,897 (Tokie), the disclosure of which is incorporated herein by reference. Of these methods, inkjet printing methods are typically well suited for applications in which high resolution is desired.

Exemplary inkjet printing methods include thermal inkjet, continuous ink-jet, piezo inkjet, acoustic inkjet, and hot melt inkjet printing. Thermal inkjet printers and/or print heads are readily commercially available, for example, from Hewlett-Packard Corporation (Palo Alto, Calif.), and Lexmark International (Lexington, Ky.). Continuous inkjet print heads are commercially available, for example, from continuous printer manufacturers such as Domino Printing Sciences (Cambridge, United Kingdom). Piezo inkjet print heads are commercially available, for example, from Trident International (Brookfield, Conn.), Epson (Torrance, Calif.), Hitachi Data Systems Corporation (Santa Clara, Calif.), Xaar PLC (Cambridge, United Kingdom), Spectra (Lebanon, N. H.), and Idanit Technologies, Limited (Rishon Le Zion, Israel). Hot melt inkjet printers are commercially available, for example, from Xerox Corporation (Stamford, Conn.).

Fluid materials used in practice of the present invention may be digitally applied (e.g., inkjet printed) to any portion of the substrate surface by various techniques including, for example, moving the substrate relative to a fixed print head, or by moving a print head relative to the substrate. Accordingly, methods of the current invention are capable of forming detailed patterns of fluid materials on the surface of a substrate. Fluid materials are typically digitally applied in a predetermined pattern (although random patterns may be used) as a coating onto a surface of the substrate as an array of dots, which depending on the wetting ability and the number of printing passes may coalesce, remain separated, or a combination thereof. For example, using inkjet printing the array may have a resolution in at least one dimension of greater than or equal to 300 dots per inch (i.e., dpi) (120 dots/cm), 600 dpi (240 dots/cm), 900 dpi (350 dots/cm), or even greater than or equal to 1200 dpi (470 dots/cm), especially if using inkjet printing techniques. Exemplary patterns include lines (e.g., straight, curved, or bent lines) that may form a geometric outline such as, for example, a polygon or an ellipse.

In some embodiments, the second fixed coating may comprise a gradient pattern of dots (e.g., a pattern having an increasing dot density along at least one dimension of the pattern). In such embodiments, the first fixed coating may be a discontinuous (e.g., an array of dots) or a continuous coating. In one exemplary such embodiment, the first and second fixed coatings may each comprise oppositely oriented gradient patterns.

By applying the first and second fluid materials to the substrate and fixing them in specific patterns, it is typically possible to create one or more fluid control elements on the surface of the substrate. Exemplary fluid control elements include conduits and wells, as shown in FIGS. 1*a,b*, 2, and 3.

Referring now to FIG. 1*a*, exemplary article 100 according to the present invention comprises substrate 102 having surface 110. First fixed coating 120 is adjacent to and encloses second fixed coating 130. First and second fixed coatings 120 and 130, respectively, meet at boundary 160 thereby forming well 150. In one embodiment that is suitable, for example, for controlling aqueous fluids, first fixed coating 120 is hydrophobic and second fixed coating 130 is hydrophilic. In one embodiment according to the present invention, first and second fixed coatings 120 and 130, respectively, may comprise continuous films.

Figure 1B:
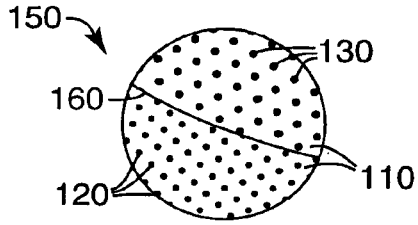
FIG. 1*b* is an enlarged view of boundary 160 in FIG. 1*a;*

In another embodiment, shown in FIG. 1*b*, first and second fixed coatings 120 and 130, respectively, each comprise a closely spaced array of dots, which dots may be of the same or different sizes. In this embodiment, boundary 160 may, or may not, continuously contact either or both of the first and second fixed coatings 120 and 130, respectively.

Figure 2:
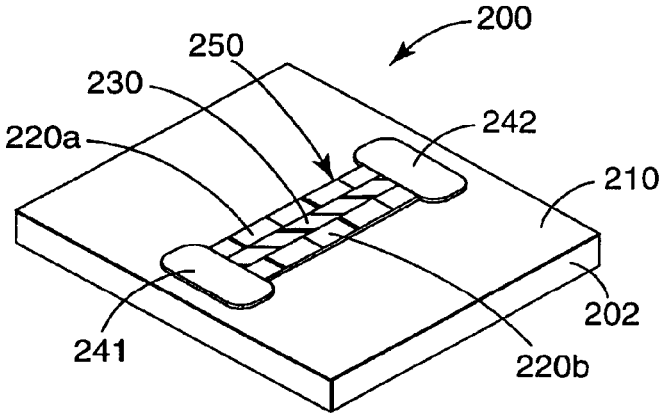
FIG. 2 is a perspective view of another exemplary article according to one embodiment of the present invention.

Referring now to FIG. 2, exemplary article 200 according to the present invention comprises substrate 202 having surface 210. Identical first fixed coatings 220*a,b* are adjacent to second fixed coating 230 forming fluid conduit 250. Generalized fluid handling components 241 and 242 are disposed at opposite ends of second fixed coating 230. In one embodiment that may be suitable, for example, for controlling aqueous fluids, first fixed coatings 220*a,b* are hydrophobic and second fixed coating 230 is hydrophilic. Accordingly, an aqueous fluid in contact with fluid handling component 241 will be drawn by capillary action along second fixed coating 230 to fluid handling component 242.

Figure 3:
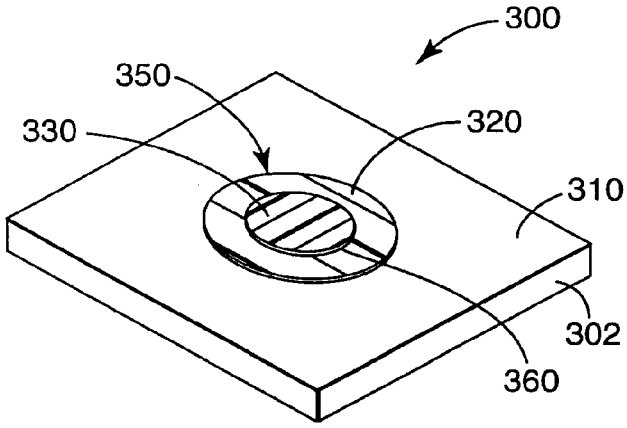
FIG. 3 is a perspective view of an exemplary article according to one embodiment of the present invention.

In another embodiment, the second fixed coating may be at least partially supported on a portion of the first fixed coating, for example, as shown in FIG. 3. Referring to FIG. 3, exemplary article 300 according to the present invention comprises substrate 302 having surface 310. First fixed coating 320 contacts surface 310. Second fixed coating 330 is supported on a portion of first fixed coating 320. Exposed surfaces of first and second fixed coatings 320 and 330, respectively, meet at boundary 360 thereby forming well 350. In one embodiment that is suitable, for example, for controlling aqueous fluids, first fixed coating 320 is hydrophobic and second fixed coating 330 is hydrophilic. In one embodiment according to the present invention, first and second fixed coatings 320 and 330, respectively, may comprise continuous films.

The first and second fixable fluid materials may be any material that may be digitally applied as a fluid to a substrate (e.g., by inkjet printing) and subsequently fixed to the surface of the substrate. Useful fixable fluid materials may be organic, inorganic, or a combination thereof.

In one embodiment according to the present invention, the first fixed coating may have a relatively low surface energy after fixing, while the second fixed coating has a relatively high surface energy (e.g., a hydrophobic first fixed coating and a hydrophilic second fixed coating). In another embodiment, the first fixed coating may have a relatively high surface energy, while the second fixed coating has a relatively low surface energy (e.g., a hydrophilic first fixed coating and a hydrophobic second fixed coating). In some cases wherein the second fluid material is applied onto at least a portion of the first fixed coating, it may be desirable that the first fixed coating have a surface energy higher than the surface tension of the second fluid material such that spontaneous wetting of the second fluid material occurs on the first fixed coating.

Useful fixable fluid materials may be, for example, solutions or dispersions in solvent, solvent-free mixtures of curable monomers, molten solids (e.g., waxes or thermoplastics at elevated temperature), and combinations thereof. In one embodiment according to the present invention, at least one of the first and second fluid materials may comprise a volatile liquid vehicle (e.g., a dispersion or a solution) with nonvolatile components dispersed and/or dissolved therein. Exemplary nonvolatile components include one or more organic polymers, polymerizable monomers and oligomers, colloidal inorganic oxide particles, and inorganic oxide precursors, and self-assembling materials. Useful organic polymers include, for example, hydrophobic polymers, hydrophilic polymers, and precursors thereof.

Fluid materials that, after fixing, exhibit a low surface energy include those materials comprising silicones, silicone precursors, fluoropolymers, fluoropolymer precursors, various self-assembling materials, and combinations thereof, optionally in combination with one or more reactive components (e.g., one or more polymerizable monomers).

In one embodiment according to the present invention, at least one of the first and second fixable fluid materials may comprise at least one of a fluoropolymer or a fluoropolymer precursor. As used herein, the term "fluoropolymer" refers to any organic fluorinated polymer (e.g., a polymer having a fluorine content of at least 20 percent by weight based on the total weight of the polymer). The fluoropolymer may, for example, be dispersed or dissolved in solvent, or be a liquid at the selected digital application temperature. Useful fluoropolymers may have fluorine on the polymer backbone and/or side chains. Fluoropolymer precursors typically comprise oligomeric and/or monomeric fluorinated organic compounds that have condensable, polymerizable, and/or crosslinkable groups, and may optionally contain one or more curatives (e.g., initiator, hardener, catalysts).

Fluoropolymer solutions useful for preparing fluoropolymer-coated substrates may be any solution comprising at least one soluble fluoropolymer and/or fluoropolymer precursor. Useful fluoropolymer and fluoropolymer precursor solutions are described, for example, in U.S. Pat. No. 4,132,681 (Field et al.); U.S. Pat. No. 4,446,269 (Silva et al.); U.S. Pat. No. 6,350,306 (Tunelli et al.); U.S. Pat. No. 5,459,191 (Tuminello et al.); U.S. Pat. No. 6,365,276 (Rudisi et al.); and in U.S. Patent Application Publication no. 2004/0241395 A1 and entitled "METHOD OF MODIFYING A SURFACE OF A SUBSTRATE AND ARTICLES THEREFROM" (Jing et al.), published Dec. 2, 2004 the disclosures of which are incorporated herein by reference.

Useful solutions of commercially available fluoropolymers and fluoropolymer precursors include, for example, thermoset FEVE fluoropolymer solutions marketed by Asahi Glass Company (Tokyo, Japan) under the trade designations "LUMIFLON LF200", "LUMIFLON LF600X", and "LUMIFLON LF910LM"; fluoropolymer solutions marketed by 3M Company under the trade designations "3M NOVEC ELECTRONIC COATING EGC-1700", "3M NOVEC ELECTRONIC COATING EGC-1702", and "3M NOVEC ELECTRONIC COATING EGC-1704"; and fluoropolymer solutions marketed by Central Glass Company (Tokyo, Japan) under the trade designations "CEFRAL COAT A202B", "CEFRAL COAT A600X", and "CEFRAL COAT PX-40".

Exemplary useful commercially available solvent soluble fluoropolymers include a copolymer of VDF and HFP having a VDF/HFP (monomer weight ratio of 90/10) available from Dyneon, LLC (Oakdale, Minn.) under the trade designation "KYNAR 2800"; a copolymer of VDF and TFE having a VDF/TFE (monomer weight ratio of 39/61) available from Dyneon, LLC (Oakdale, Minn.) under the trade designation "KYNAR 7201"; and terpolymers of VDF, HFP, and TFE monomers (VDF/HFP/TFE) having the trade designations "THV 200" (monomer weight ratio 40/20/40), "L-5447" (monomer weight ratio 65/11/24), "KYNAR 9301" (monomer weight ratio 56/19/25), "DYNEON FLUOROELASTOMER FE-5530" (monomer weight ratio 63/28/9), "DYNEON FLUOROELASTOMER FT-2481" (monomer weight ratio 44/33/23), "DYNEON FLUOROELASTOMER FE-5730" (monomer weight ratio 41/35/24), and "DYNEON FLUOROELASTOMER FE-5830" (monomer weight ratio 36.6/38.5/24.9); and fluoropolymers marketed by E. I. du Pont de Nemours & Company under the trade designations "TEFLON AF 1600" and "TEFLON AF 2400".

The choice of solvent to dissolve the fluoropolymer typically depends on the specific fluoropolymer. Methods for selecting appropriate solvents are well known in the art. Exemplary organic solvents that may be used for dissolving the fluoropolymer include amides (e.g., N,N-dimethylformamide), ketones (e.g., methyl ethyl ketone), alcohols (e.g., methanol), ethers (e.g., tetrahydrofuran), hydrofluoroethers (e.g., those available from 3M Company under the trade designations "3M NOVEC ENGINEERED FLUID HFE 7100", "3M NOVEC ENGINEERED FLUID HFE-7200"), perfluorinated solvents (e.g., a perfluorinated organic solvent available from 3M Company under the trade designation "3M FLUORINERT ELECTRONIC LIQUID FC-77"), and combinations thereof.

Useful dispersible fluoropolymers include, for example, those described in U.S. Pat. No. 6,518,352 (Visca et al.); U.S. Pat. No. 6,451,717 (Fitzgerald et al.); U.S. Pat. No. 5,919,878 (Brothers et al.); and PCT patent publication WO 02/20676 A1 (Krupers et al., published Mar. 14, 2002); the disclosures of which are incorporated herein by reference.

Useful dispersions of commercially available fluoropolymers and fluoropolymer precursors include, for example, polyvinylidene difluoride (PVDF) dispersions (e.g., as that marketed by Atofina Chemical (Philadelphia, Pa.) under the trade designation "KYNAR 500"); polytetrafluoroethylene (PTFE) dispersions (e.g., as marketed by E. I. du Pont de Nemours & Company under the trade designations "TEFLON PTFE GRADE 30", "TEFLON PTFE GRADE 307A"; or as marketed by Dyneon under the trade designations "DYNEON TF 5032 PTFE" or "DYNEON TF 5050 PTFE"); tetrafluoroethylene-hexafluoropropylene-vinylidene fluoride dispersions (e.g., as marketed by Dyneon under the trade designations "DYNEON THV 220D FLUOROTHERMOPLASTIC" and "DYNEON THV 340D FLUOROTHERMOPLASTIC").

Self-assembling materials are typically relatively small (e.g., having less than or equal to 30 carbon atoms, or even less than or equal to 18 carbon atoms) molecules, and are generally characterized by a relatively non-polar tail attached to a polar head group that can coordinate with a substrate surface. Useful self-assembling materials include those that can be fixed (e.g., tightly bound as a monolayer) to the surface of the substrate (e.g., by covalent or non-covalent bonding) as described, for example, in U.S. Pat. No. 6,433,359 (Kelley et al.) and U.S. Pat. No. 6,376,065 (Korba et al.), the disclosures of which is incorporated herein by reference. Such materials may be especially useful for metallic substrates such as for example, copper, nickel, silver, and gold.

Exemplary useful self-assembling materials include those having the formula $$R_f—Z—X$$

wherein $R_f$ is a perfluoroalkyl group having from 1 to 22 carbon atoms;

Z is a divalent connecting group or a covalent bond; and

X is selected from the group consisting of $—PO_3H$, $—CO_2H$,

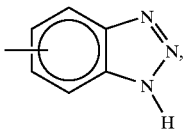

and salts thereof.

Useful perfluoroalkyl groups $R_f$ include linear perfluoroalkyl groups (e.g., perfluoromethyl, perfluoropropyl, perfluorohexyl, perfluorooctyl, perfluorodecyl, perfluorohexadecyl, and perfluoroeicosyl) and branched perfluoroalkyl groups (e.g., perfluoroisopropyl, perfluoroisooctyl, and perfluoro(1,1,2-trimethylpentyl)).

Useful divalent connecting groups include, for example, a covalent bond; an organic group such as linear or branched divalent alkylene having from 1 to 22 carbon atoms (e.g., methylene, ethylene, propylene, decylene) or divalent arylene having from 6 to 10 carbon atoms; divalent aromatic hydrocarbons (e.g., phenylene); sulfur; oxygen; alkylimino (e.g., —NR—, wherein R is a lower alkyl group); carbonyl; carbonyloxy; carbonylamino; carbonyldioxy; sulfonyl; sulfonyloxy; sulfonamido; carbonamido; sulfonamidoalkylene (e.g., $—SO_2NR_1(CH_2)_x—$, wherein x is 1 to 6 and $R_1$ is lower alkyl having 1 to 4 carbon atoms); carbonamidoalkylene; carbonyloxy; ureylene; and combinations thereof. Other divalent connecting groups may also be used. In some embodiments, Z may be selected to be free of active hydrogen atoms (e.g., hydroxyl or acidic hydrogen atoms) or other hydrophilic groups, as these may tend to reduce the advancing contact angle with water of coatings prepared from such materials. In some embodiments, Z may be relatively small (e.g., having less than 20 atoms in the backbone connecting $R_f$ and X).

Useful X groups include $—PO_3H$, $—CO_2H$,

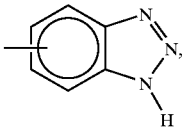

and salts thereof.

Exemplary useful salts include alkali metal salts (e.g. sodium, lithium, and potassium salts), ammonium salts and derivatives thereof (e.g., ammonium, alkylammonium, and quaternary ammonium salts), and quaternary phosphonium salts (e.g., tetramethylphosphonium and phenyltributylphosphonium salts)

In some cases, it may be desirable to select $R_f$ and Z such that, taken together, $R_f$ and Z comprise at least 7 carbon atoms.

Further details concerning self-assembling materials and methods for their preparation may be found, for example, in U.S. Patent Application Publication No. US2004/241396 A1 and entitled "METHOD OF MODIFYING A SURFACE OF A SUBSTRATE AND ARTICLES THEREFROM" (Jing et al.), published Dec. 2, 2004; the disclosure of which is incorporated herein by reference.

In one embodiment according to the present invention, at least one of the first and second fixable fluid materials may comprise at least one silicone and/or silicone precursor (e.g., monomers, oligomers, and polymers having one or more reactive silyl groups such as $—SiR^1_{3-n}(OR^2)_n$, wherein $R^1$ represents an aryl or alkyl group, each $R^2$ independently represents H, an alkyl group (e.g., having from 1 to 6 carbon atoms), or an acyl group, and n is 1, 2, or 3) that may be cured to form silicones as described in, for example, U.S. Pat. No. 6,461,419 (Wu et al.), the disclosure of which is incorporated herein by reference.

Exemplary silicones and silicone precursors include hydroxy and/or alkoxy terminated polydimethylsiloxanes having a molecular weight of 400 to 150,000; hydroxy and/or alkoxy terminated diphenylsiloxane-dimethylsiloxane copolymers; hydroxy and/or alkoxy terminated polydiphenylsiloxanes; hydroxysilyl and/or alkoxysilyl terminated polytrifluoropropylmethylsiloxanes, polyesters, polyurethanes, and polyacrylates; dialkyl- and substituted dialkyl dialkoxysilanes (e.g., diethyldiethoxysilane, dimethyldimethoxysilane, diethyldiethoxysilane, diisobutyldimethoxysilane, dimethyldiethoxysilane, diisopropyldimethoxysilane, bis(3-cyanopropyl)dimethoxysilane, (2-chloroethyl) methyldimethoxysilane, chloromethylmethyldiethoxysilane, (2-chloroethyl) methyldiisopropoxysilane, (3-chloropropyl) methyldimethoxysilane,(3-cyanopropyl) methyldimethoxysilane, cyclohexylethyldimethoxysilane, dodecylmethyldiethoxysilane, isobutylmethyldimethoxysilane, 3-mercaptopropylmethyldimethoxysilane, mercaptomethylmethyldiethoxysilane, methacryloxypropylmethyldiethoxysilane, methacryloxypropylmethyldimethoxysilane, methyldiethoxysilane, methyldimethoxysilane, n-octadecylmethyldiethoxysilane; n-octylmethyldiethoxysilane, dicyclopentyldimethoxysilane); aryl and diaryl substituted alkoxysilanes (e.g., diphenyldimethoxysilane, phenyldiethoxysilane, phenylmethyldiethoxysilane, and phenylmethyldimethoxysilane); hydroxysilyl and alkoxysilyl substituted arenes (e.g., 1,4-bis(hydroxydimethylsilyl) benzene and 1,3-bis(methoxydimethylsilyl)benzene); trialkylsilyl substituted alkoxysilanes (e.g., bis (trimethylsilylmethyl)dimethoxysilane and trimethylsilylmethyldimethoxysilane); cyclic alkoxysilanes (e.g., 1,1-diethoxy-1-silacyclopent-3-ene); acyloxy substituted silanes (e.g., dimethyldiacetoxysilane, vinylmethyldiacetoxysilane, and diethylbenzoyloxyacetoxysilane); geminal silanediols (e.g., diphenylsilanediol, and dicyclohexylsilanediol); alkyl and/or aryl substituted cyclic siloxanes (e.g., 3-(3,3,3-trifluoropropyl) heptamethyltrisiloxane, hexamethyltrisiloxane, and octamethyltetrasiloxane); alkenyl substituted alkoxysilanes (e.g., vinylethyldiethoxysilane, vinylmethyldimethoxysilane, and vinylphenyldiethoxysilane); and combinations thereof.

In one embodiment according to the present invention, silicone precursors may contain at least one compound having at least 3 (e.g., from 4 to 6) reactive silyl groups per molecule. The reactive silyl groups may be, for example, alkoxy silyl or acyloxy silyl groups. Examples of such compounds include trifunctional crosslinkers (e.g., isobutyltrimethoxysilane, methytriethoxysilane, methytrimethoxysilane, octyltriethoxysilane, propyltrimethoxysilane, phenyltrimethoxysilane, chloropropyltriethoxysilane, chloropropyltriethoxysilane, mercaptopropyltrimethoxysilane, glycidyloxypropyltrimethoxysilane, methacryloxypropyltrimethoxysilane, vinyltriethoxysilane, and vinyltrimethoxysilane); tetrafunctional crosslinkers (e.g., tetramethoxysilane, tetraethoxysilane, 1,3-dimethyltetramethoxydisiloxane, 1,3-di-n-octyltetramethoxydisiloxane, 1,3-divinyltetraethoxydisiloxane, 1,1,3,3-tetraethoxy-1,3-dimethyldisiloxane, tetrakis(butoxyethoxyethoxy)silane, tetrakis(ethoxyethoxy)silane, tetrakis(trimethylsiloxy) silane, tetrakis(2-ethylhexoxy)silane, tetrakis(2-methacryloxyethoxysilane), tetrakis(methoxyethoxyethoxy) silane, tetrakis(methoxyethoxy)silane, tetrakis (methoxypropoxy)silane, tetra-n-propoxysilane); and higher functionality crosslinkers (e.g., bis[3-(methyldimethoxysilyl)propyl]-polypropylene oxide, bis (triethoxysilyl)ethane, bis(triethoxysilyl)ethylene, bio (triethoxysilyl)methane, 1,9-bis(triethoxysilyl)nonane, bis (triethoxysilyl)-1,7-octadiene, bis(triethoxysilyl)octane, bis [3-(triethoxysilyl)propyl]-tetrasulfide, bis(3-(triethoxysilyl) propyl)urea, bis(trimethoxysilyl)ethane, 1,4-bis (trimethoxysilylethyl)benzene, bis(trimethoxysilyl)hexane, bis(trimethylsiloxy)cyclobutene, di-t-butoxydiacetoxysilane, hexamethoxydisilane, hexaethoxydisilane, tetraacetoxysilane, tetraallyloxysilane, tetra-n-butoxysilane, 1-triethoxysilyl)-2-(diethoxymethylsilyl)ethane; and functional polymers (e.g., poly(diethoxysiloxane), diethoxysiloxane-s-butylaluminate copolymers, diethoxysiloxane-ethyltitanate copolymers, diethoxysiloxane-ethyl phosphate copolymers); and combinations thereof. Additional silicone-based fixable fluid materials are described in, for example, U.S. Pat. No. 5,217,805 (Kessel et al.) and U.S. Pat. No. 5,286,815 (Leir et al.), the disclosures of which are incorporated herein by reference.

Either or both of the first and second fixable fluid materials may optionally contain at least one curing agent (e.g., catalyst, initiator, photoinitiator, crosslinker, hardener, or the like) in an amount effective to at least partially cure the fixable fluid material. Such curing agents are typically selected based on the specific chemical nature of the fixable fluid material using methods well known in the art.

One useful class of catalysts includes acid generating catalysts. Such catalysts provide acid (for example, after an activation step) that facilitates curing (i.e., crosslinking) of cationically polymerizable components (e.g., silicone precursors having hydrolyzable groups) that may be present in the first fluid material. Activation may be accomplished by heating or irradiating the first fluid material with, for example, ultraviolet, visible light, electron beam or microwave radiation. Moisture required for the initial hydrolysis reaction of the curing mechanism may be obtained from, for example, the substrate, the material itself, or, most commonly, atmospheric humidity. If used, catalyst is typically present in an amount of 0.1 to 20 parts by weight, for example, from 2 to 7 parts by weight, based on 100 parts by weight reactive silane functional compounds. Further details concerning useful acid catalysts may be found, for example, in U.S. Pat. No. 5,554,664 (Lamanna et al.); U.S. Pat. No. 5,514,728 (Lamanna et al.); and U.S. Pat. No. 5,340,898 (Cavezzan et al.), the disclosures of which are incorporated herein by reference.

Silicones, silicone precursors, fluoropolymers, fluoropolymer precursors, fluorinated self-assembling materials, and combinations thereof may be present at any concentration in the fixable first material. However, to facilitate the rate of deposition of such materials on the substrate surface their concentration in the fixable first material may be greater than 5, 10, 20, 30, 40, or even greater than 50 percent by weight, based on the total weight of the material. Silicones, silicone precursors, fluoropolymers, fluoropolymer precursors, fluorinated self-assembling materials, and combinations thereof may comprise greater than 20, 30, 40, 50, 60, 70, 80, or even 90 percent by weight of the non-volatile components content of the fixable first material.

In another embodiment, at least one of the first and second fixable fluid materials may comprise a combination of the foregoing fluoropolymers and silicones, and/or precursors thereof, and/or self-assembling materials.

In one embodiment according to the present invention, at least one of the first and second fixable fluid materials may comprise a hydrophilic coating precursor such as, for example, a solution of a hydrophilic polymer or a precursor thereof, or a colloidal inorganic oxide sol or a precursor thereof, or a combination thereof.

Useful hydrophilic polymers include hydroxylic polymers (e.g., vinyl alcohol homopolymers and copolymers, polyacrylic acid homopolymers and copolymers); amide functional polymers (e.g., vinyl pyrrolidone homopolymers and copolymers, polyacrylamide homopolymers and copolymers); polyethers (e.g., polyethylene oxide, polypropylene oxide, and polymers containing segments of the same); cellulosic polymers (e.g., carboxymethyl cellulose, hydroxypropylmethyl cellulose, hydroxyethyl cellulose, and mixtures thereof), sulfonated fluoropolymers, and combinations thereof.

Useful colloidal inorganic oxides typically comprise particles of at least one inorganic oxide suspended in a dispersion medium. The inorganic oxide may comprise, for example, at least one oxide comprising at least one element selected from aluminum, zirconium, silicon, titanium, tin, indium, zinc, lead, germanium, hafnium, chromium, copper, iron, cobalt, nickel, manganese, vanadium, yttrium, niobium, tantalum, and molybdenum. Exemplary colloidal inorganic oxides (including sols) include colloidal alumina, colloidal silica, colloidal zirconia, and combinations thereof. If used, inorganic colloids should typically have a maximum particle size smaller than any orifice (e.g., a nozzle) through which they must pass. Typically, colloidal inorganic oxides with a maximum particle size of less than 100 nanometers (e.g., less than 20 nm) may be used for inkjet printing methods. Further details regarding inkjet printable colloidal inorganic oxides may be found, for example, in U.S. Pat. No. 6,485,138 (Kubota et al.). The dispersion medium is typically water or a mixed solvent comprising water and at least one organic solvent having good compatibility with water, (e.g., methanol, ethanol, and isopropyl alcohol). Colloidal inorganic oxides are readily commercially available from suppliers such as, for example, Nyacol Nanotechnologies, Inc. (Ashland, Mass.) under the trade designation "NYACOL", from Bayer Corporation (Pittsburgh, Pa.) under the trade designation "LEVASIN", and from Nissan Chemical America Corp. (Houston, Tex.) under the trade designation "SNOWTEX".

In some embodiments according to the present invention, fixed first materials may have a receding contact angle with water of greater than 80 degrees or even greater than 110 degrees.

Receding contact angles may be readily measured according to a variety of methods that are well known in the art, including for example, ASTM D5725-99 "Standard Test Method for Surface Wettability and Absorbency of Sheeted Materials Using an Automated Contact Angle Tester" (1999). In instances, wherein the surface area of the material to be evaluated is too small for analysis or wherein the surface has topographical features that may influence the results obtained, results based on a larger smooth film of the same composition should be used.

At least one of the first and second fixable fluid materials may contain solvent (e.g., volatile solvent). Solvent may be present in amount sufficient to adjust the viscosity of the first fluid material, for example, to a viscosity suitable for a chosen digital application method. For example, if inkjet printing is chosen as the digital application method, the first fluid material may be adjusted by addition of solvent to a viscosity of less or equal to 30 millipascal seconds at 60° C. Exemplary solvents include water, organic solvents (e.g., mono-, di- or tri-ethylene glycols or higher ethylene glycols, propylene glycol, 1,4-butanediol or ethers of such glycols, thiodiglycol, glycerol and ethers and esters thereof, polyglycerol, mono-, di- and tri-ethanolamine, propanolamine, N,N-dimethylformamide, dimethylsulfoxide, dimethylacetamide, N-methylpyrrolidone, 1,3-dimethylimidazolidone, methanol, ethanol, isopropanol, n-propanol, diacetone alcohol, acetone, methyl ethyl ketone, propylene carbonate), and combinations thereof.

Either or both of the first and second fixable fluid materials may contain one or more optional additives such as, for example, colorants (e.g., dyes and/or pigments), thixotropes, thickeners, or a combination thereof. However, in cases wherein that a material is forced through a small orifice during application to the substrate surface (e.g., inkjet printing) it may be desirable to use a material that is essentially free of dispersed particulates that may tend to clog the orifice.

The first and second fixable fluid materials may be prepared by combining constituent components according to one or more well known techniques such as, for example, stirring, heating, sonicating, milling, and combinations thereof. Typically, any solid substrate may be used in practice of the present invention. For example, useful substrates may be opaque, translucent, clear, textured, patterned, rough, smooth, rigid, flexible, treated, primed, or a combination thereof. The substrate typically comprises organic and/or inorganic material. The substrate may be, for example, thermoplastic, thermoset, or a combination thereof. Exemplary substrates include films, plates, tapes, rolls, molds, sheets, blocks, molded articles, fabrics, and fiber composites (e.g., circuit boards), and may comprise at least one organic polymer such as polyimide, polyester, acrylic, polyurethane, polyether, polyolefin (e.g., polyethylene or polypropylene), polyamide, and combinations thereof. Exemplary inorganic substrates include metals (e.g., chromium, aluminum, copper, nickel, silver, gold, and alloys thereof), ceramics, glass, china, quartz, polysilicon, and combinations thereof.

The substrate surface may be treated, for example, to promote adhesion of the fluoropolymer to the substrate surface. Exemplary treatments include corona, flame, and chemical treatments. Chemical treatment (e.g., treatment with a coupling agent) of the substrate surface often enhances adhesion of the first and/or second fixed coatings to the substrate surface. Suitable coupling agents include conventional titanate coupling agents, zirconate coupling agents, and silane coupling agents that are capable of affording titanium, zirconium, or silicon oxides upon pyrolysis. Exemplary silane coupling agents include vinyltriethoxysilane, gamma-mercaptopropyltrimethoxysilane, allyltriethoxysilane, diallyldichlorosilane, gamma-aminopropyltrimethoxysilane, triethoxysilane, trimethoxysilane, triethoxysilanol, 3-(2-aminoethylamino) propyltrimethoxysilane, tetraethyl orthosilicate, and combinations thereof. If used, coupling agents may be applied neat or from a solution thereof in, for example, a volatile organic solvent. Further details on chemical surface treatment techniques are described in, for example, S. Wu "Polymer interface and Adhesion" (1982), Marcel Dekker, New York, pages 406–434.

After digital application, the first and second fluid materials are fixed to the surface of the substrate. As used herein, the term "fixed" means bound (e.g., physically and/or chemically) to the substrate surface. Fixing may be, for example, spontaneous (e.g., as in the case of some thixotropic materials) or result from an additional step. Exemplary methods of fixing include evaporation (e.g., removal of volatile solvent), cooling (e.g., resulting in a phase change from liquid to solid, or viscosity thickening), and curing (e.g., polymerization and/or crosslinking).

Evaporation may be achieved, for example, by any of a variety of conventional methods, including air drying, oven drying, microwave drying, and evaporation under reduced pressure (e.g., vacuum). During evaporation, non-volatile components of the first and/or second fixed coatings are deposited on the surface of the substrate, for example, as a continuous or discontinuous thin film.

The first and second fixable fluid materials should typically be selected such that, the surface energy of the first and second fixed coatings, respectively, are different. For example, one of the fixed materials may be hydrophilic and the other hydrophobic. Accordingly, a difference in surface energy typically causes any subsequent fluid that may be applied to either of the first or second fixed materials to preferentially wet out on the surface of either the first or second fixed material.

The boundary or boundaries between adjacent fixed coatings on the substrate surface may be continuous, or they may be discontinuous if the spacing between adjacent discontinuous portions is sufficiently close as to prevent spontaneous wetting of a third fluid material to a portion of the substrate.

Typically, the effectiveness of fluid control elements prepared according to the present invention increases with an increase in the magnitude of the difference in surface energy between the first and second fixed materials. Thus, if aqueous fluids are to be controlled the magnitude of the difference in average receding contact angle with water between the first and second fixed materials should be greater than zero. For example, the magnitude of the difference in average receding contact angle with water between the first and second fixed materials may be at least 30, 40, 50, 60, 70, or even at least 90 degrees. For applications wherein aqueous fluids are involved, it may be desirable that one or both of the first and second fixed materials may have a relatively low average receding contact angle with water (e.g., less than 20 degrees) in order to promote wetting of the surface of the fixed material(s). On the other hand, if wetting by aqueous fluid is desired, it may be useful that one or both of the first and second fixed materials have a relatively higher average receding contact angle with water (e.g., greater than 80 degrees and/or greater than 110 degrees).

Methods according the present invention have utility in the manufacture of a variety of articles, including, for example, microfluidic devices (e.g., lab on a chip and drug delivery devices), analytical test strips (e.g., blood glucose test strips).

Articles prepared according to the present invention may be used by themselves, or in combination with a third material (typically a fluid). In such instances a third fluid material is typically brought into contact with at least one of the first and second fixed materials, wherein, for example, it may be confined or directed along a fluid conduit by capillary action. Exemplary third fluid materials include water and biological fluids (e.g., serum, urine, saliva, tears, and blood), organic solvents (including fluorinated organic solvents), and inks. The third material may be coated by any method including, for example, knife coating, gravure coating, flood coating, rod coating, bar coating, and spray coating.

Objects and advantages of this invention are further illustrated by the following non-limiting examples, but the particular materials and amounts thereof recited in these examples, as well as other conditions and details, should not be construed to unduly limit this invention.

EXAMPLES

Unless otherwise noted, all reagents used in the examples were obtained, or are available, from general chemical suppliers such as Aldrich Chemical Company (Milwaukee, Wis.) or may be synthesized by known methods.

In the following examples, contact angles were measured using deionized water and a contact angle measurement apparatus obtained under the trade designation "VCA 2500XE VIDEO CONTACT ANGLE MEASURING SYSTEM" from AST Products (Billerica, Mass.). Reported contact angles represent an average value determined from measurement of at least three drops.

Preparation of Fluoropolymer Dispersion A:

A 250 mL 3-necked flask was fitted with a condenser, a stirring rod, and a thermometer. A nitrogen fitting was also attached to the glassware with a mineral oil bubbler at the outlet of the condenser. The flask was charged with 25 g of N-methylperfluorooctylsulfonamidoethyl acrylate (preparable according to the general procedure described in U.S. Pat. No. 2,803,615 (Ahlbrecht et al.)), 32 g of acetone, 128 g of water, 0.2 g of a water-soluble free radical initiator obtained under the trade designation "V-50" from Wako Chemicals USA, Inc. (Richmond, Va.), and 1.7 g of surfactant obtained under the trade designation "ETHOQUAD 18/12" from Akzo Nobel Chemicals, Inc. (Chicago, Ill.). The mixture was stirred under nitrogen for 20 minutes, with heating at 65° C. using a heating mantle and a thermal controller. The reaction was allowed to proceed for 8 hours while watching and controlling the exotherm. The reaction product was cooled, drained, filtered, and stripped of acetone by evaporation at reduced pressure. The resulting dispersion (Fluoropolymer Dispersion A) was cooled to room temperature. The dispersion had particle size of less than 100 nm as measured by dynamic light scattering. The solids content of the dispersion was 15 percent by weight and the surface tension was 28 dynes/centimeter.

General Procedure for Preparation of Sulfopolyester Diol Precursor (PCPSSIP)

A mixture of 337.3 parts of dimethyl 5-sodiosulfoisophthalate, 483 parts of diethylene glycol, and 0.82 parts zinc acetate was heated at 180° C., and the methanol by-product was distilled from the reaction mixture. After 4.5 hours $^1$H NMR analysis of the reaction product showed that less than 1 percent residual methyl ester was present in the product. Dibutyltin dilaurate (1.51 parts) was added to the reaction mixture, the temperature held at 180° C., and 1753 parts epsilon-caprolactone (obtained from Union Carbide Corp. (Danbury, Conn.)) was added portionwise over about a 30-minute period. When addition was complete, the reaction mixture was held at 180° C. for 4 hours, then cooled to afford the product, a polycaprolactone sodium sulfoisophthalate (PCPSSIP).

Preparation of SUS Dispersion A

An aqueous dispersion of a silanol-terminated sulfopoly (ester-urethane) was prepared by combining in a 1-liter 3-neck round bottom flask: 64.8 g of PCPSSIP (prepared according to the General Procedure for Preparation of Sulfopolyester Diol Precursor, and having a hydroxyl equivalent weight=370 g/equivalent), 10.86 g of polycaprolactone diol (obtained under the trade designation "TONE 201" from Union Carbide Corporation, hydroxyl equivalent weight of 262 g/equivalent), 14.30 g of ethylene glycol, 80.36 g of isophorone diisocyanate, 0.13 g of dibutytin dilaurate, and 90 mL of methyl ethyl ketone. The mixture was stirred with heating at 80° C. for 4 hours, after which time a solution of 5.34 g of 3-aminopropyltriethoxysilane and 5.34 g of butyl amine in 83 mL of methyl ethyl ketone was added to the flask and the mixture stirred at 55° C. for an additional 15 minutes. As the mixture was vigorously stirred, 260 mL of water was added to the flask over a 15-minute period. The flask was then fitted with a distillation head and a condenser and the methyl ethyl ketone was distilled out of the flask under reduced pressure to afford a dispersion of a silanol-terminated sulfopoly(ester-urethane) in water. (SUS Dispersion A, 41 percent solids).

Preparation of SUS Dispersion B

An aqueous dispersion of a silanol-terminated sulfopoly (ester-urethane) was prepared by combining in a 1-liter 3-neck round bottom flask: 857.5 g of PCPSSIP (prepared according to the General Procedure for Preparation of Sulfopolyester Diol Precursor, and having a hydroxyl equivalent weight of 333 g/equivalent), 655 g of polycaprolactone diol (obtained under the trade designation "TONE 201" from Union Carbide Corporation), 749.4 g of 4,4'-methylenebis(cyclohexyl isocyanate), 1.1 mL of dibutytin dilaurate, and 2261.8 g of acetone. The mixture was stirred for 38 hours at 45° C., then a solution of 141.1 g of 3-aminopropyltriethoxysilane in 141 g of acetone was added to the flask and the mixture stirred at 45° C. for an additional 15 minutes. As the mixture was vigorously stirred, 3566 g of water was added to the flask over a 30-minute period. The flask was then fitted with a distillation head and a condenser and the methyl ethyl ketone was distilled out of the flask under reduced pressure to afford a dispersion of a silanol-terminated sulfopoly(ester-urethane) in water (SUS Dispersion B, 43 percent by weight solids)

EXAMPLE 1

A fixable first fluid material (FFM1) was prepared by combining, with mixing by hand, 12 g SUS Dispersion A, 12 g SUS Dispersion B, 12.66 g diethylene glycol, 13.34 g of deionized water, and 0.205 g of a silicone surfactant obtained under the trade designation "SILWET L-77" from Crompton OSi Specialties (Middlebury, Conn.).

A second fluid material (SFM1) was prepared by combining, with mixing by hand, 15 g of Fluoropolymer Dispersion A, 7.0 g of diethylene glycol, and 0.205 g of a silicone surfactant obtained under the trade designation "SILWET L-77" from Crompton OSi Specialties.

The FFM1 and SFM1 materials were inkjet printed onto a vinyl sheet (50 micrometers thickness, obtained under the trade designation "CONTROLTAC PLUS GRAPHIC FILM 180-10" from 3M Company) using a print head (obtained under the trade designation "XAARJET XJ128-360" from Xaar, PLC (Cambridge, United Kingdom)). The print head was mounted in fixed position, and the vinyl sheet was mounted on an x-y translatable stage, which was moved relative to the print head while maintaining a constant distance between the print head and the stage. Accordingly, the materials were printed at room temperature (35V pulse voltage; 1.25 kHz firing frequency) at a resolution of 295×317 dots per inch (116×124 dots per cm) with a nominal drop volume of 30 picoliters.

Figure 4:
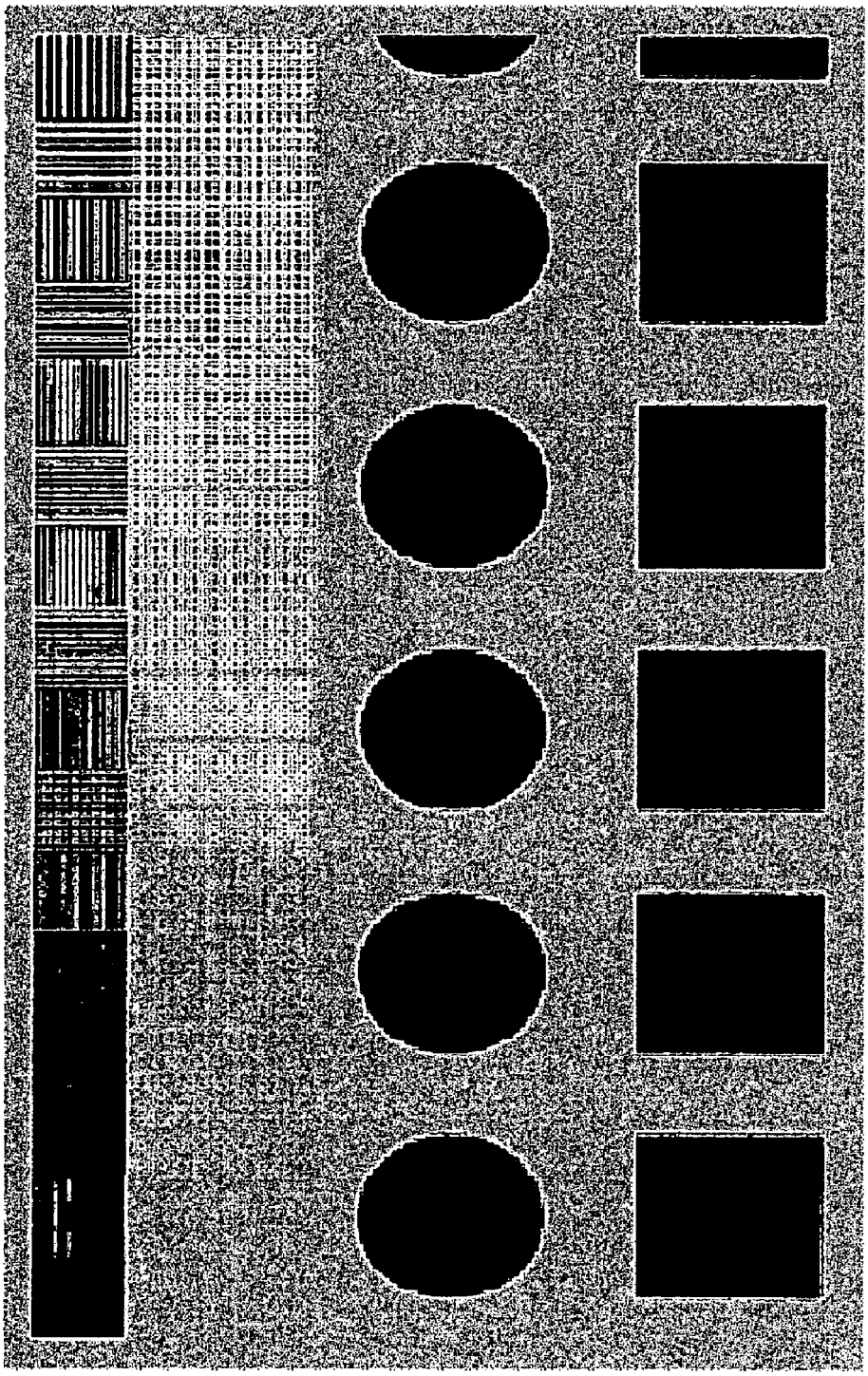
FIG. 4 is a digital photograph of a print pattern used in the examples.

FFM1 material was inkjet printed twice (i.e., printed then over-printed in registration) onto the vinyl sheet in a 4.5 inches×6 inches (11 cm×15 cm) solid filled rectangular pattern, and then dried at 70° C. in a convection oven. Next, SFM1 material was inkjet printed four times onto the vinyl sheet according to a pattern as shown in FIG. 4 (for scaling purposes, the large squares in the printed pattern were one inch (2.54 cm) on each side), wherein areas corresponding to dark areas in FIG. 4 were printed with the SFM1 material, and then dried at 130° C. in a convection oven.

The resultant printed film had square and circular regions of fixed hydrophobic coating (resulting from drying SFM1 material) printed onto, and surrounded by, an adjacent fixed hydrophilic coating (resulting from drying FFM1 material). The fixed hydrophobic coating had static/advancing/receding contact angles with deionized water of 121/130/91 degrees, respectively. The fixed hydrophilic coating had static/advancing/receding contact angles with deionized water of 75/86/27 degrees, respectively.

Figure 5:
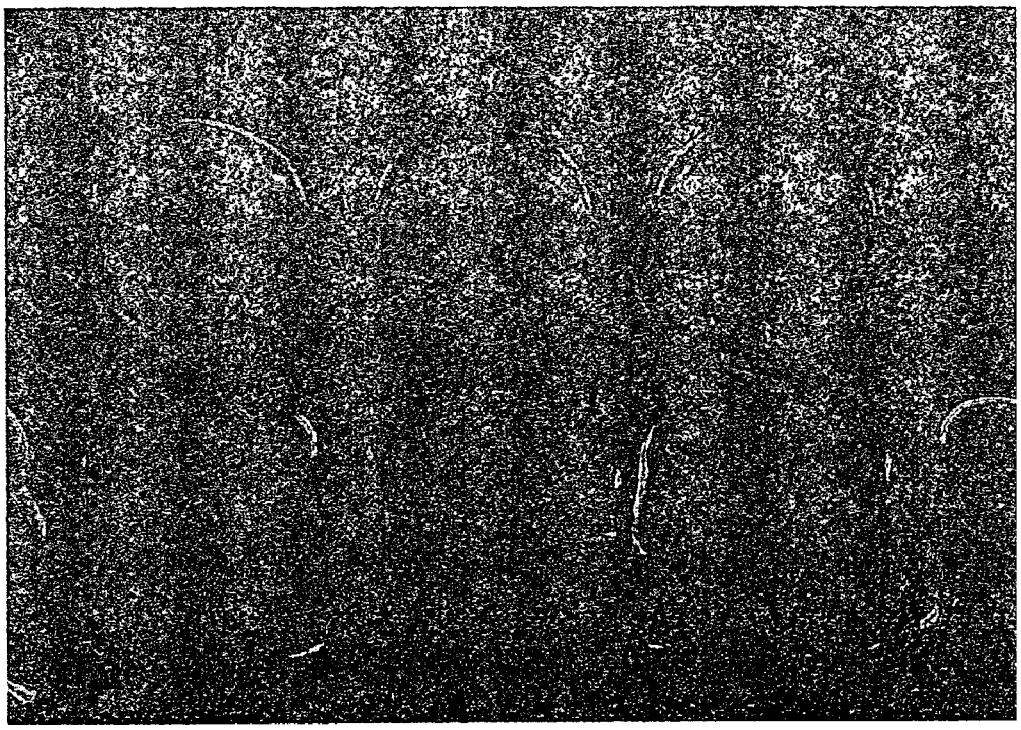
FIG. 5 is a digital photograph of a wetted coated film prepared according to one exemplary embodiment of the present invention.

This coated film was flood coated with water. The water receded from regions of the film that were coated with hydrophobic coating, but wet out the surface coated with hydrophilic coating as shown in FIG. 5.

FFMI material was coated onto vinyl sheet (50 micrometers thickness, obtained under the trade designation "CONTROLTAC PLUS GRAPHIC FILM 180-10" from 3M Company) using a Number 6 wire wound rod obtained from R D Specialties (Webster, N.Y.) and dried by heating in an oven at 70° C. for 5 minutes. The resulting dried coating had static/advancing/receding contact angles with deionized water of 73/80/26 degrees, respectively.

SFMI material was coated onto vinyl sheet (50 micrometers thickness, obtained under the trade designation "CONTROLTAC PLUS GRAPHIC FILM 180-10" from 3M Company) using a Number 6 wire wound rod obtained from R D Specialties and dried by heating in an oven at 135° C. for 5 minutes. The resulting dried coating had static/advancing/receding contact angles with deionized water of 118/124/109 degrees, respectively.

EXAMPLE 2

The procedure of Example 1 was repeated except that, FFM1 was printed twice in registration according to a pattern that was the inverse of that shown in FIG. 4 (i.e., light areas of FIG. 4 were printed). The resultant printed film had square and circular regions of fixed hydrophobic coating (resulting from drying SFM1 material) surrounded by an adjacent fixed hydrophilic coating (resulting from drying FFM1 material).

Figure 6:
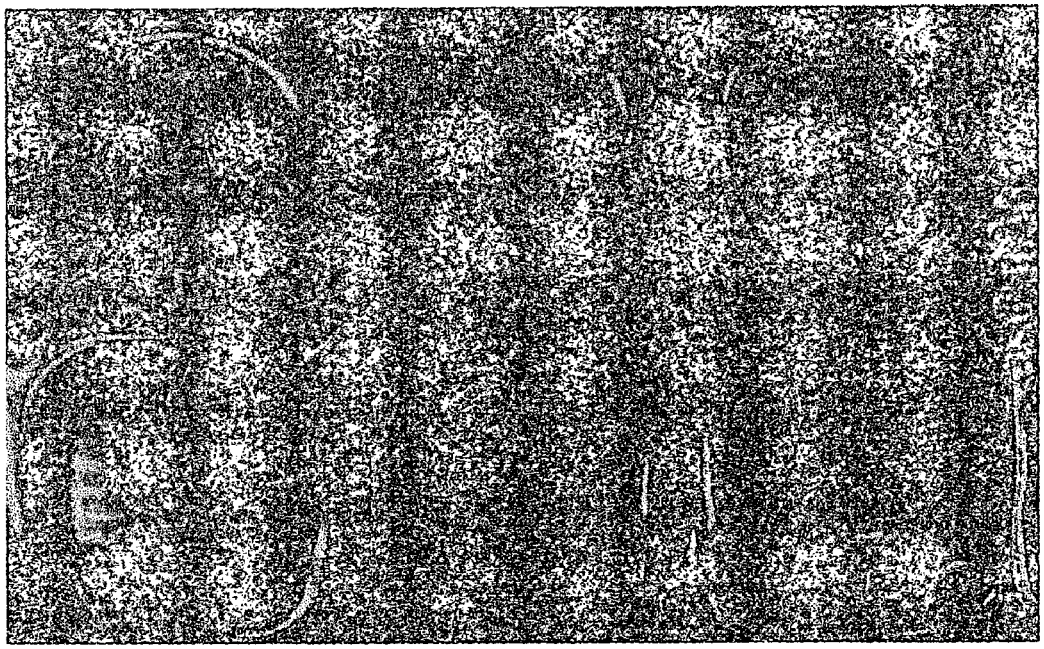
FIG. 6 is a digital photograph of a wetted coated film prepared according to one exemplary embodiment of the present invention.

This coated film was flood coated with water. The water receded from regions of the film that were coated with hydrophobic coating, but wet out the surface coated with hydrophilic coating as shown in FIG. 6.

EXAMPLE 3

A fixable first fluid material (FFM2) was prepared by combining, with mixing by hand, 2.5 g of polyacrylic acid (Catalog No. 32,366-7,2000 molecular weight by GPC obtained from Aldrich Chemical Company), 2.5 g of colloidal silica (20 nm particle diameter; 40 percent by weight solids, obtained under the trade designation "NALCO 2327" from Ondea Nalco, (Naperville, Ill.)), 45 g of deionized water, and 0.066 g of a silicone surfactant obtained under the trade designation "SILWET L-77" from Crompton OSi Specialties.

The procedure of Example 1 was repeated except that FFM2 was substituted for the FFM1 used in Example 1.

The resultant printed film had square and circular regions of fixed hydrophobic coating (resulting from drying the SFM1 material) printed onto, and surrounded by, an adjacent fixed hydrophilic coating (resulting from drying the FFM2 material). The fixed hydrophobic coating had static/advancing/receding contact angles with water of 114/116/77 degrees, respectively. The fixed hydrophilic coating had static/advancing/receding contact angles with water of 75/82/34 degrees, respectively.

Figure 7:
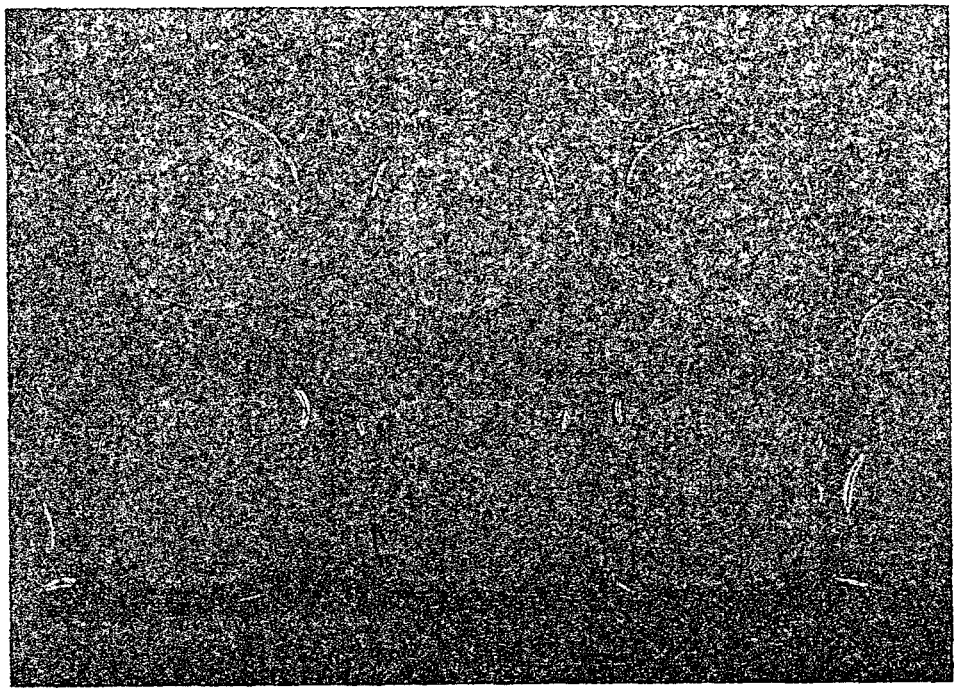
FIG. 7 is a digital photograph of a wetted coated film prepared according to one exemplary embodiment of the present invention.

This coated film was wetted with water. The water receded from regions of the film that were coated with hydrophobic coating, but wet out the surface coated with hydrophilic coating as shown in FIG. 7.

FFM2 material was coated onto vinyl sheet (50 micrometers thickness, obtained under the trade designation "CONTROLTAC PLUS GRAPHIC FILM 180-10" from 3M Company) using a Number 6 wire wound rod obtained from R D Specialties and dried by heating in an oven at 70° C. for 5 minutes. The resulting dried coating had static/advancing/receding contact angles with deionized water of 75/82/34 degrees, respectively.

EXAMPLE 4

The procedure of Example 3 was repeated except that, FFM2 was printed twice in registration according to a pattern that was the inverse of that shown in FIG. 4 (i.e., light areas of FIG. 4 were printed). The resultant printed film had square and circular regions of fixed hydrophobic coating (resulting from drying the SFM1 material) surrounded by an adjacent fixed hydrophilic coating (resulting from drying the FFM2 material).

Figure 8:
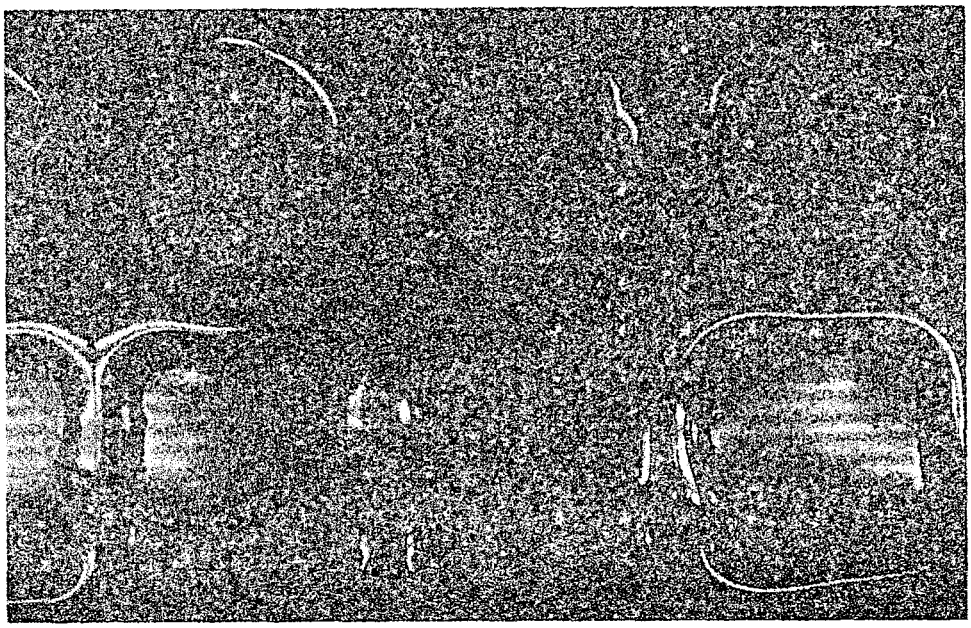
FIG. 8 is a digital photograph of a wetted coated film prepared according to one exemplary embodiment of the present invention.

This coated film was wetted with water. The water receded from regions of the film that were coated with hydrophobic coating, but wet out the surface coated with hydrophilic coating as shown in FIG. 8.

Various unforeseeable modifications and alterations of this invention may be made by those skilled in the art without departing from the scope and spirit of this invention, and it should be understood that this invention is not to be unduly limited to the illustrative embodiments set forth herein.

What is claimed is:

1. A method of modifying a surface of a substrate comprising:

providing a substrate having a surface;

digitally applying a first fixable fluid material to at least a portion of the surface of the substrate;

fixing the first fixable fluid material to provide a first fixed coating on at least a portion of the surface of the substrate, wherein the first fixed coating has a first average receding contact angle with water;

digitally applying a second fixable fluid material to at least one of a portion of the surface of the substrate and a portion of the first fixed coating; and fixing the second fluid material to provide a second fixed coating, wherein the second fixed coating is adjacent to the first fixed coating, wherein the second fixed coating has a second average receding contact angle with water, wherein the magnitude of the difference between the first and second average receding contact angles is at least 30 degrees.

2. A method according to claim 1, wherein the second fixed coating contacts the first fixed coating.

3. A method according to claim 1, wherein the second fixed coating is not identically superimposed on the first fixed coating.

4. A method according to claim 1, wherein the difference between the first and second receding contact angles is at least 70 degrees.

5. A method according to claim 1, wherein the difference between the first and second receding contact angles is at least 90 degrees.

6. A method according to claim 1, wherein the second fixed coating has a receding contact angle with water of less than 20 degrees.

7. A method according to claim 1, wherein the fixed first material has a receding contact angle with water of greater than 80 degrees.

8. A method according to claim 1, wherein the fixed first material has a receding contact angle with water of greater than 110 degrees.

9. A method according to claim 1, wherein the second material is applied to a region of the first fixed coating.

10. A method according to claim 1, wherein at least one of the first and second fluid materials has a viscosity of less than 30 millipascal seconds at 60 degrees Celsius.

11. A method according to claim 1, wherein at least one of the first and second fluid materials is applied by inkjet printing.

12. A method according to claim 1, wherein at least one of the first and second fluid materials is applied by piezo inkjet printing.

13. A method according to claim 1, wherein fixing at least one of the first and second fluid materials comprises drying.

14. A method according to claim 1, wherein fixing at least one of the first and second fluid materials comprises cooling.

15. A method according to claim 1, wherein fixing the first material or the second fluid material comprises at least one of polymerizing or crosslinking.

16. A method according to claim 1, wherein the substrate comprises at least one of polysilicon, ceramic, glass, fabric, or an organic polymer.

17. A method according to claim 1, wherein at least one of the first and second fluid materials comprises at least one of a fluoropolymer dispersion, a fluoropolymer solution, a silicone polymer, or a combination thereof.

18. A method according to claim 1, wherein at least one of the first and second fluid materials comprises a self assembling material having the formula:

Rf—Z—X wherein $R_f$ is a perfluoroalkyl group having from 1 to 22 carbon atoms;

Z is a divalent connecting group or a covalent bond; and

X is selected from the group consisting of —$PO_3H$, —$CO_2H$,

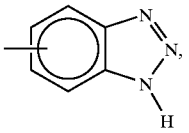

and salts thereof.

19. A method according to claim 1, wherein the second fluid material comprises at least one hydrophilic polymer.

20. A method according to claim 1, wherein one of the first or second fixed coatings is hydrophilic, and wherein one of the first or second fixed coatings is hydrophobic.

21. A method according to claim 1, further comprising applying a third material to at least one of the first and second fixed materials.

22. A method according to claim 21, wherein the third material comprises a biological fluid.

23. A method according to claim 21, wherein the third material comprises water.

24. A method according to claim 1, wherein at least one of the first and second fixed coatings comprises an array of dots, and wherein the array has a resolution in at least one dimension of greater than or equal to 300 dots per inch.

25. A method according to claim 24, wherein the resolution is greater than 600 dots per inch.

26. A method according to claim 1, wherein at least one of the first and second regions comprises at least one design element selected from the group consisting of a line, a conduit, an alphanumeric character, and a circle.

27. An article prepared according to the method of claim 1.

28. An article comprising a substrate having a surface, and first and second fixed coatings, wherein the first fixed coating has a first receding contact angle with water and contacts the substrate, wherein the second fixed coating has a second receding contact angle with water and contacts at least one of the substrate and the first fixed coating, wherein the first and second fixed coatings are adjacent, wherein the magnitude of the difference between the first and second receding contact angles is at least 30 degrees, and wherein at least one of the first and second fixed coatings comprises an array of dots having a resolution in at least one dimension of greater than or equal to 300 dots per inch.

29. An article according to claim 28, wherein the second fixed coating contacts the first fixed coating.

30. An article according to claim 28, wherein the second fixed coating is not identically superimposed on the first fixed coating.

31. An article according to claim 28, wherein the resolution is greater than 600 dots per inch.

32. An article according to claim 28, wherein the difference between the first and second receding contact angles is at least 70 degrees.

33. An article according to claim 28, wherein the difference between the first and second receding contact angles is at least 90 degrees.

34. An article according to claim 28, wherein the second fixed coating has a receding contact angle with water of less than 20 degrees.

35. An article according to claim 28, wherein the first fixed coating has a receding contact angle with water of greater than 80 degrees.

36. An article according to claim 28, wherein the first fixed coating has a receding contact angle with water of greater than 110 degrees.

37. An article according to claim 28, wherein the substrate comprises at least one of polysilicon, ceramic, glass, fabric, or organic polymer.

38. An article according to claim 28, wherein the substrate is flexible.

39. An article according to claim 28, wherein at least one of the first and second fixed coatings comprises a self assembling material having the formula:

$$R^f—Z—X$$

wherein $R_f$ is a perfluoroalkyl group having from 1 to 22 carbon atoms;

Z is a divalent connecting group or a covalent bond; and

X is selected from the group consisting of $—PO_3H$, $—CO_2H$,

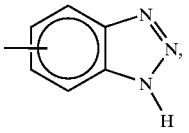

and salts thereof.

40. An article according to claim 28, wherein the second fixed coating comprises at least one hydrophilic polymer.

41. An article according to claim 28, wherein one of the first or second fixed coatings is hydrophilic, and wherein one of the first or second fixed coatings is hydrophobic.

* * * * *

UNITED STATES PATENT AND TRADEMARK OFFICE

CERTIFICATE OF CORRECTION

PATENT NO. : 6,969,166 B2
DATED : November 29, 2005
INVENTOR(S) : Clark, John C.

It is certified that error appears in the above-identified patent and that said Letters Patent is hereby corrected as shown below:

Title page,
Item [57], ABSTRACT,
Line 3, insert -- . -- following "energies".

Column 3,
Line 45, delete "ink-jet" and insert -- inkjet --.

Column 6,
Line 6, insert -- , -- following "2004".

Column 18,
Line 15, delete "Rf" and insert -- $R_f$ --.

Column 20,
Line 5, delete "$R^f$" and insert -- $R_f$ --.

Signed and Sealed this

Twenty-first Day of February, 2006

JON W. DUDAS
*Director of the United States Patent and Trademark Office*